US009867423B2

(12) United States Patent
Girard

(10) Patent No.: US 9,867,423 B2
(45) Date of Patent: Jan. 16, 2018

(54) BOOT HAVING A FIRST FOOTWEAR ELEMENT AND A SECOND FOOTWEAR ELEMENT

(71) Applicant: SALOMON S.A.S., Metz-Tessy (FR)

(72) Inventor: Francois Girard, Veryrier du Lac (FR)

(73) Assignee: SALOMON S.A.S., Metz-Tessy (FR)

( * ) Notice: Subject to any disclaimer, the term of this patent is extended or adjusted under 35 U.S.C. 154(b) by 297 days.

(21) Appl. No.: 14/168,563

(22) Filed: Jan. 30, 2014

(65) Prior Publication Data

US 2014/0215854 A1 Aug. 7, 2014

(30) Foreign Application Priority Data

Feb. 1, 2013 (FR) ..... 13 00212

(51) Int. Cl.

| | |
|---|---|
| ***A43B 3/16*** | (2006.01) |
| ***A43B 3/10*** | (2006.01) |
| ***A43B 3/12*** | (2006.01) |
| ***A43B 5/00*** | (2006.01) |
| ***A43B 3/18*** | (2006.01) |
| ***A43C 15/06*** | (2006.01) |
| ***A43C 11/12*** | (2006.01) |

(52) U.S. Cl.

CPC ..... *A43B 5/002* (2013.01); *A43B 3/18* (2013.01); *A43C 11/12* (2013.01); *A43C 15/068* (2013.01)

(58) Field of Classification Search

CPC ..... A43B 5/002; A43B 5/004; A43B 3/18; A43C 15/068; A43C 11/12

USPC ..... 36/100, 101, 103, 114

See application file for complete search history.

(56) References Cited

U.S. PATENT DOCUMENTS

| | | | | | |
|---|---|---|---|---|---|
| 395,271 | A | * | 12/1888 | Benedict | A43B 3/16 36/58.6 |
| 395,338 | A | | 1/1889 | Long | |
| 1,524,805 | A | | 2/1925 | Anderson | |
| 2,188,603 | A | | 1/1940 | Hamalainen | |
| 2,666,996 | A | * | 1/1954 | Odland | A43B 3/16 36/50.1 |
| 2,825,155 | A | | 3/1958 | Hines | |
| 3,006,084 | A | * | 10/1961 | Le Compte | A43B 3/02 36/3 A |
| 3,810,318 | A | * | 5/1974 | Epstein | A43B 5/00 36/105 |
| 4,351,120 | A | * | 9/1982 | Dalebout | A43B 5/0419 36/117.3 |

(Continued)

FOREIGN PATENT DOCUMENTS

DE 86 22 239 U1 10/1986

*Primary Examiner* — Jila M Mohandesi

(74) *Attorney, Agent, or Firm* — Greenblum & Bernstein, P.L.C.

(57) ABSTRACT

A boot having a first footwear element and a second footwear element, the second footwear element being configured to be removably inserted into the first footwear element, the first element footwear extending lengthwise from a rear end to a front end, widthwise between a lateral side and a medial side, and height-wise from a base to an upper end, the second footwear element extending lengthwise from a rear end to a front end, widthwise between a lateral side and a medial side, and height-wise from a base to an upper end. The boot includes a retaining device to retain the rear end of the second footwear element at the rear end of the first footwear element.

26 Claims, 7 Drawing Sheets

(56) References Cited

U.S. PATENT DOCUMENTS

| | | | | | |
|---|---|---|---|---|---|
| 4,392,311 | A * | 7/1983 | Rudolf | A43B 3/16 | 36/50.1 |
| 4,542,599 | A * | 9/1985 | Annovi | A43B 5/0419 | 36/117.4 |
| 4,620,375 | A * | 11/1986 | Wallace | A43C 15/068 | 36/125 |
| 4,979,319 | A * | 12/1990 | Hayes | A43B 5/04 | 36/114 |
| 5,822,888 | A * | 10/1998 | Terry | A43B 3/246 | 36/100 |
| 6,345,454 | B1 * | 2/2002 | Cotton | A43B 3/24 | 36/101 |
| 6,467,192 | B1 * | 10/2002 | Egtvedt | A43B 3/166 | 36/117.6 |
| 6,481,121 | B1 * | 11/2002 | Tucker | A43B 13/26 | 36/15 |
| 6,988,328 | B2 * | 1/2006 | Rosen | A43B 11/02 | 36/59 R |
| 7,010,872 | B2 * | 3/2006 | Pawlus | A43B 3/0047 | 36/100 |
| 7,140,129 | B2 * | 11/2006 | Newson | A43B 5/18 | 36/100 |
| 7,377,058 | B2 * | 5/2008 | Elkington | A43B 3/0047 | 36/10 |
| 7,451,557 | B2 * | 11/2008 | McDonald | A43B 1/0063 | 36/100 |
| 7,908,774 | B2 * | 3/2011 | Mirza | A43B 1/0036 | 36/137 |

* cited by examiner 1
9
11
32
2
10
19
7
13
5
14
22
8
6
L
17
26
16
15
25
18
12
3
W

BOOT HAVING A FIRST FOOTWEAR ELEMENT AND A SECOND FOOTWEAR ELEMENT

CROSS-REFERENCE TO RELATED APPLICATION

This application is based upon French Patent Application No. 13/00212, filed Feb. 1, 2013, the disclosure of which is hereby incorporated by reference thereto in its entirety, and the priority of which is claimed under 35 U.S.C. §119.

BACKGROUND

1. Field of the Invention

The invention relates to a boot comprising a first footwear element and a second footwear element, the second footwear element being adapted to be inserted into the first footwear element. The invention also relates to an assembly including a crampon as well as a boot with two footwear elements.

Boots according to the invention can be used in fields such as walking or running on flat or mountainous terrain, climbing, skiing on snow, snowshoeing, and the like.

Boots according to the invention can receive the foot of the wearer with sufficient comfort, while enabling accurate transmission of the impulses applied by the wearer and sensory information related to walking, running, or steering an apparatus, such as a sports apparatus, for example. This is important, for example when running or climbing, activities for which the performance of a user is conditioned by these factors, among other things.

2. Background Information

It has long been known to manufacture a boot with a first footwear element and a second footwear element, the second footwear element being adapted to be removably inserted into the first footwear element.

A first example is that of a boot comprising an outer envelope, referred to as the first footwear element, and a liner, referred to as the second footwear element. The outer envelope has properties such as resistance to wear due to walking, resistance to abrasion, ability to dampen impact forces, ability to cooperate with a crampon, imperviousness, and the like. The liner may provide a certain comfort with respect to wrapping the foot, thermal insulation, and the like. The liner may be provided with a sole assembly for walking in a mountain refuge, for example.

A second example is that of a boot comprising an outer envelope, referred to as the first footwear element, and an inner boot, referred to as the second footwear element. Here, the outer envelope is an overboot that provides additional properties to the inner boot. In particular, the outer envelope may include a high upper and have good imperviousness. The inner boot is sufficient in itself for walking or running, except in cases in which an additional capability, such as imperviousness, is necessary. With an inner boot according to the second example, which can be a low-upper inner boot, the user can undertake an intense or sporting practice. Alternatively, if necessary, the user may associate the first and second footwear elements to adapt to various conditions, such as rain or snow, for example. One advantage for the user is having the minimum weight on each foot when seeking performance.

In all cases in which the second footwear element is positioned in the first footwear element, known boots provide a certain comfort, and enable a transmission impulse and sensory information. This makes walking, running, or steering an apparatus generally efficient. Sometimes, however, comfort is insufficient and/or the transmission of impulses and sensory information is incomplete.

This happens for example when the second footwear element moves inside the first footwear element, with small displacements that negatively affect comfort and accuracy.

To maintain the second footwear element in the first footwear element, the prior art has, for example, shaped the outer envelope of the second footwear element as a function of the inner envelope of the first footwear element, so that one fits precisely inside the other. However, despite the efforts made toward achieving such objectives, undesired displacements of the second footwear element are still observed in the first footwear element.

In view of the foregoing, therefore, boots according to the prior art are not entirely satisfactory in the sense that they do not provide adequate comfort in all situations and in the sense that they do not allow full transmission of the impulses and sensory information.

SUMMARY

A boot according to the present invention improves upon prior art boots and particularly boots intended for the practice of the sporting activities, such as those mentioned above. In particular, the invention optimizes comfort in the boot. More specifically, the invention reduces or even eliminates the unwanted movements of the second footwear element within the first footwear element.

Furthermore, the invention optimizes the transmission of impulses and sensory information, i.e., forces applied by the wearer via the boot and forces received by the boot during use.

To this end, the invention provides a boot comprising a first footwear element and a second footwear element, the second footwear element being configured to be removably inserted into the first footwear element, the first footwear element extending lengthwise from a rear end to a front end, widthwise between a lateral side and a medial side, and heightwise from a base to an upper end, the second footwear element extending lengthwise from a rear end up to a front end, widthwise between a lateral side and a medial side, and heightwise from a base to an upper end.

The boot according to the invention comprises a retaining device configured to retain the rear end of the second footwear element at the rear end of the first footwear element.

The retaining device, with great precision, even completely, retains the rear end of the second footwear element in relation to the rear end of the first footwear element. In particular, the retention occurs along the height, in a direction perpendicular to the base. As a result, the unwanted movements between the rear ends of the two footwear elements are very small or even non-existent. In addition, the second footwear element is better-retained in its entirety within the first footwear element. The resulting advantages include an improved overall comfort of the boot according to the invention, as well as a better perception of the support forces and a better transmission of sensory information.

Generally speaking, the invention can be said to have improved a boot intended for the sporting activities mentioned above.

BRIEF DESCRIPTION OF DRAWINGS

Other characteristics and advantages of the invention will be better understood from the description which follows, with reference to the annexed drawings illustrating, by way of non-limiting embodiments, how the invention may be embodied, and in which.

DETAILED DESCRIPTION

The first embodiment described below relates, for example, to a walking boot or a mountain boot, for traveling on flat ground or mountainous terrain. However, the invention applies to other fields, such as those mentioned above.

The first embodiment is described with reference to FIGS. 1 to 7.

Figure 1:
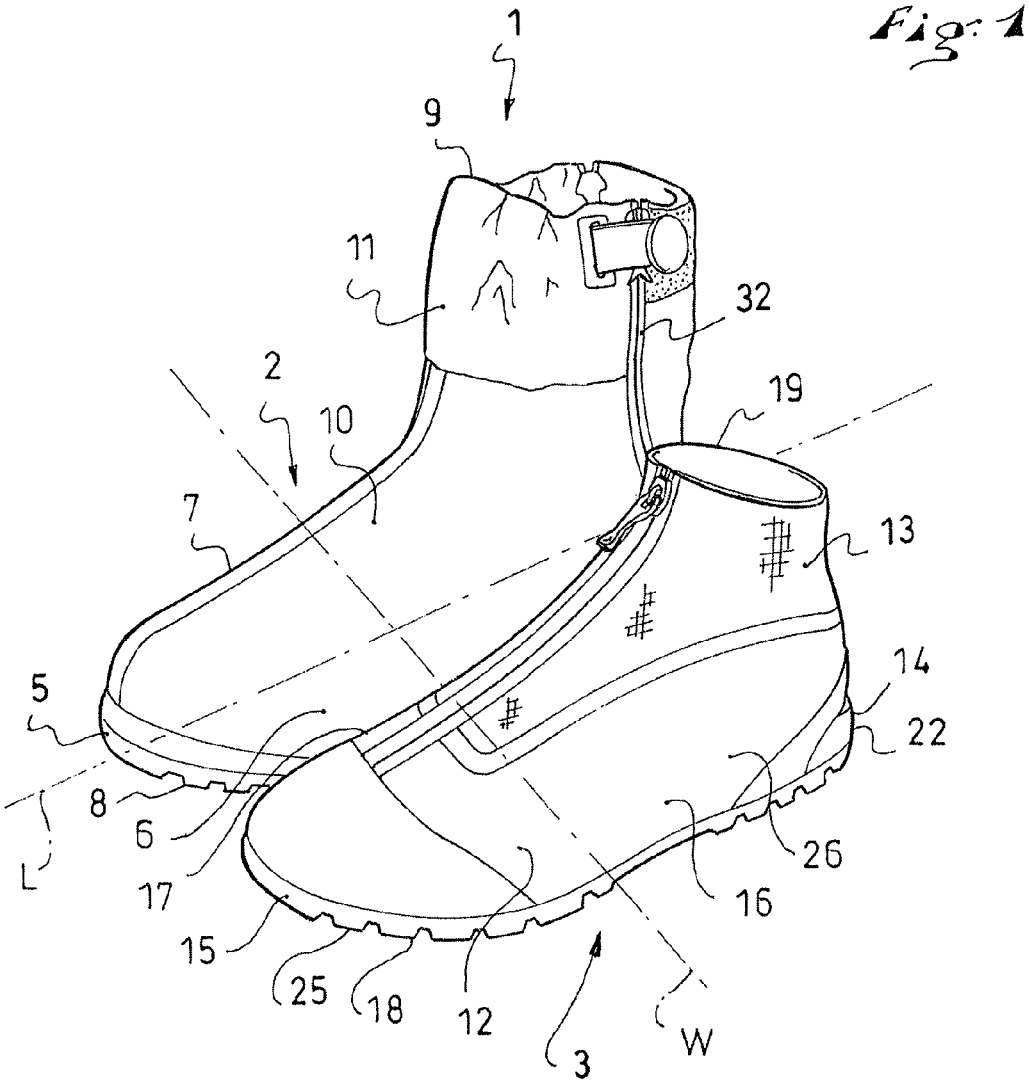
FIG. 1 is a front perspective view of a boot according to a first embodiment of the invention, in a case in which the first footwear element and second footwear element are separated.
Figure 2:
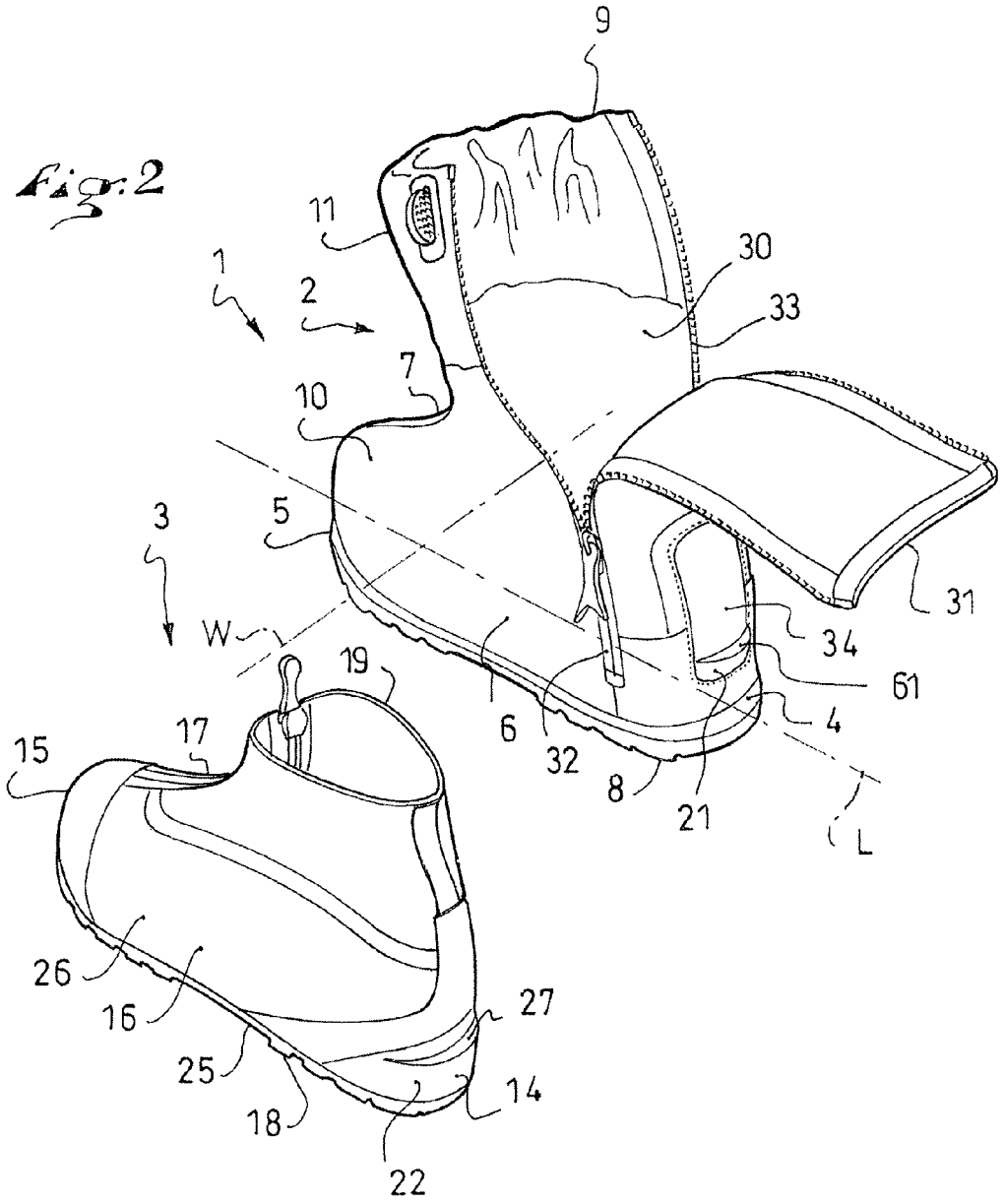
FIG. 2 is a rear perspective view of the boot of FIG. 1, still in the case in which the first footwear element and second footwear element are separated.
Figure 3:
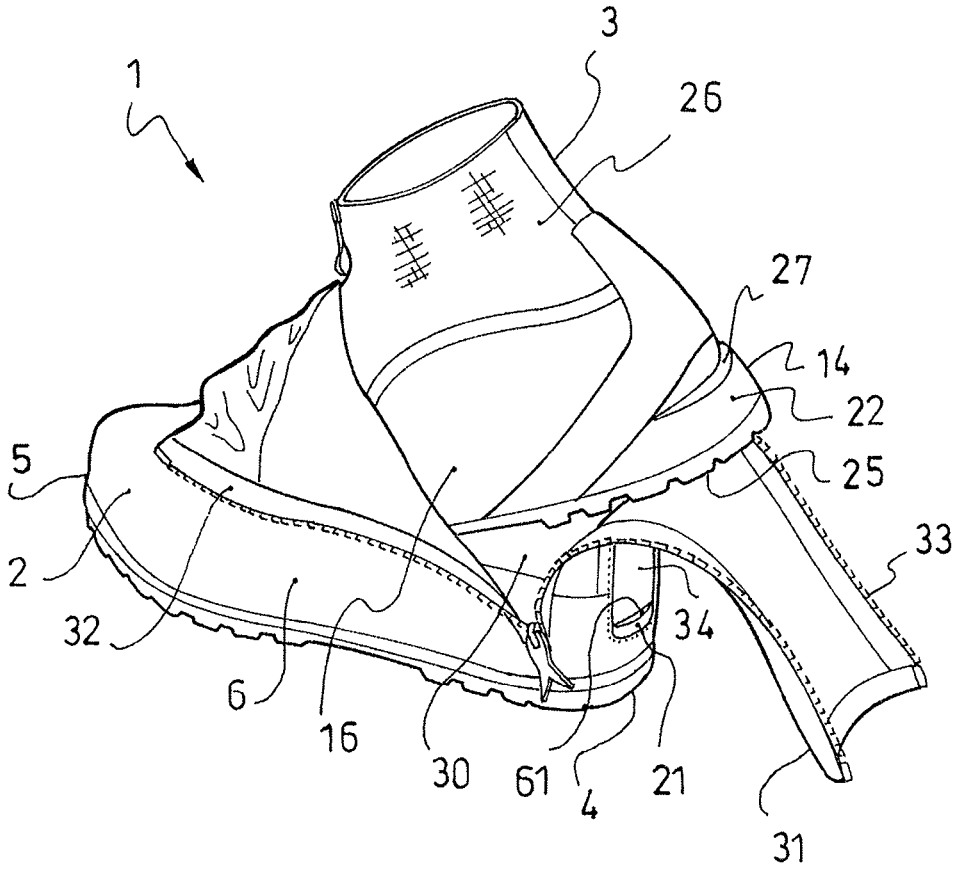
FIG. 3 is a rear perspective view showing the insertion of the second footwear element into the first footwear element.
Figure 4:
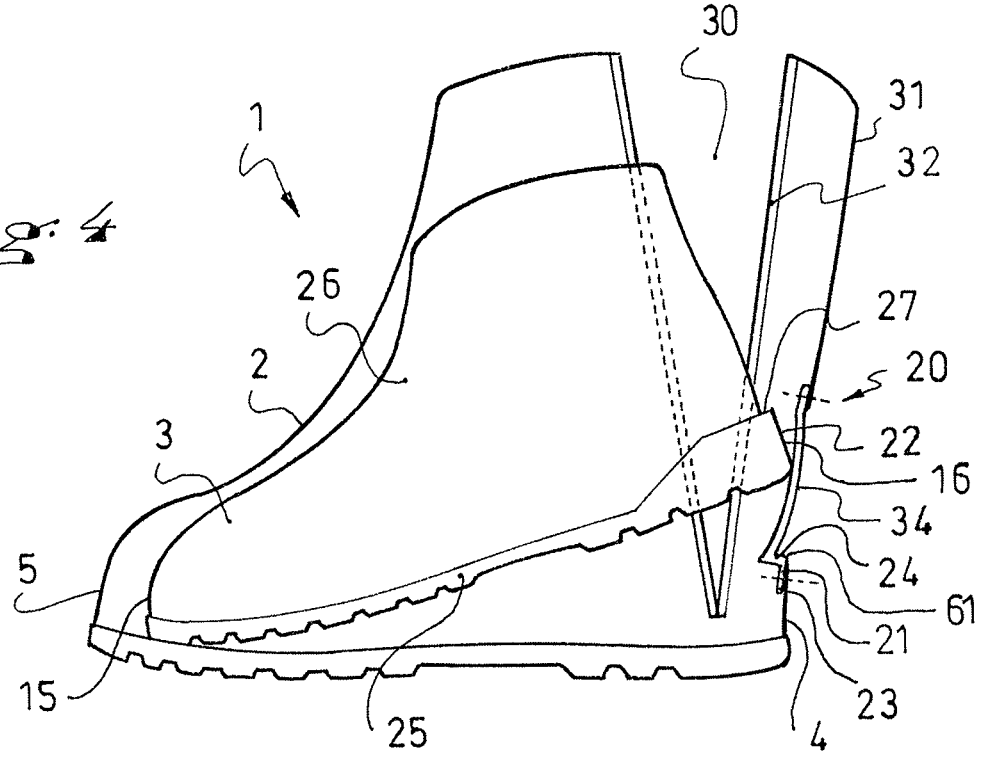
FIG. 4 is a schematic side view showing the beginning of insertion of the second footwear element into the first footwear element.

As shown in particular in FIGS. 1 and 2, a walking boot 1 is configured to receive the wearer's foot. In a known manner, the boot 1 includes a first footwear element 2 and a second footwear element 3, the second footwear element 3 being constructed to be inserted into the first footwear element. The first footwear element 2 is an outer element, directly exposed to possible contact with obstacles and can sometimes be splashed with water, snow, or ice. By corollary, the second footwear element 3 is an inner element, adapted to be removably inserted into the first footwear element. This means that the user can selectively position the second footwear element 3 in the first footwear element or, conversely, remove it therefrom.

The first footwear element 2 extends lengthwise along a longitudinal direction L from a rear end 4, or heel, to a front end 5, or tip; widthwise along a transverse direction W, between a lateral side 6 and a medial side 7; and height-wise from a base 8 to an upper end 9.

As shown, the first footwear element 2 includes a lower portion 10, provided to cover the foot, as well as an upper portion 11, provided to cover the ankle and possibly a portion of the lower leg of the wearer. Alternatively, only the lower portion 10 may be provided, excluding any upper portion. However, according to the first embodiment, the first footwear element 2 is provided with the ability to protect the second footwear element and, more broadly, the ability to protect the foot and a portion of the lower leg against splashing water, snow, pieces of ice, or other foreign matter.

Additional particularities of the first footwear element 2 are described below.

The second footwear element 3 extends lengthwise along the longitudinal direction L, from a rear end, or heel 14, to a front end, or tip 15; widthwise along the transverse direction W, between a lateral side 16 and a medial side 17; and height-wise from a base 18 to an upper end 19.

Figure 5:
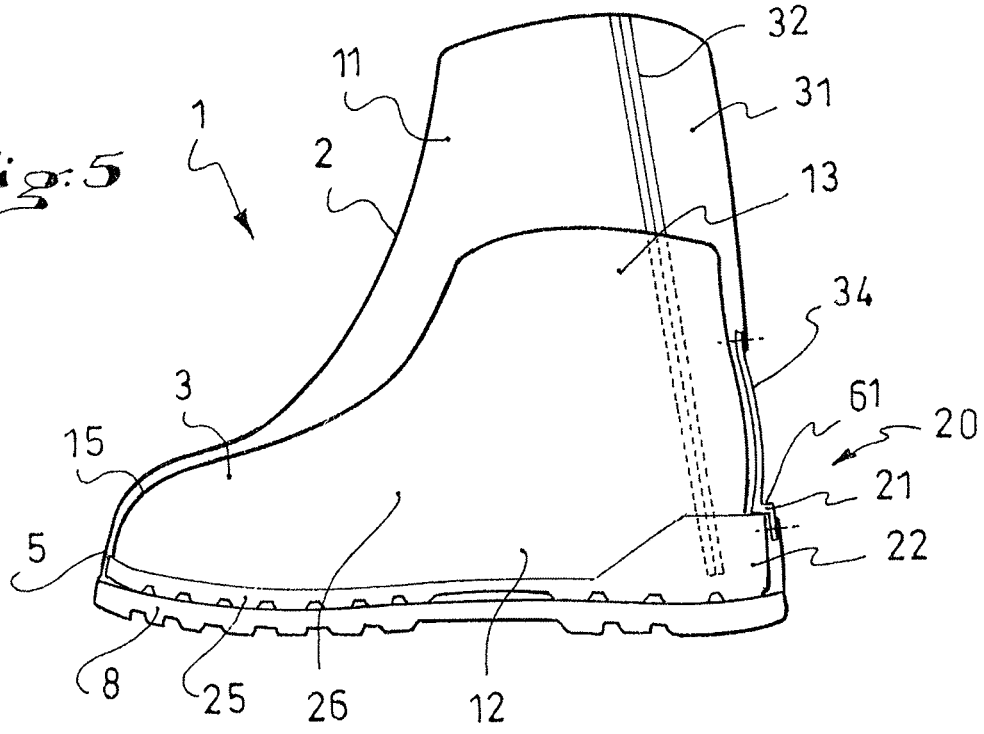
FIG. 5 is a schematic side view showing the retention of the second footwear element in the first footwear element, after insertion.

As shown, the second footwear element 3 includes a lower portion 12 provided to cover the foot, and an upper portion 13 provided to cover the ankle and possibly a portion of the lower leg of the wearer. Alternatively again, only the lower portion 12 may be provided, excluding any upper portion. However, the upper portion 13 of the second footwear element 3 has a lower height than that of the upper portion 11 of the first footwear element 2, as shown in FIG. 5, for example, whereby the entirety of the circumferential edge of the upper end 19 of the second footwear element 3 is lower than the upper end 9 of the first footwear element 2. This enables the first footwear element 2 to directly tighten the lower leg, above the second footwear element 2, for better imperviousness. By corollary, the second footwear element 3, when used alone, makes it possible to achieve better sports performance, because its reduced height causes a reduction in mass, compared to an equivalent element of greater height.

Here again, other particularities of the second footwear element 3 are described below.

According to the invention, as can be understood with reference to FIGS. 1-7, the boot 1 comprises a retaining device 20 (including first and second parts 21, 22) structured and arranged to retain the rear end 14 of the second footwear element 3 at the rear end 4 of the first footwear element 2. Thus, the retaining device 20 can be referred to as a second-footwear-element retainer. The device 20, which is described in greater detail below, significantly limits or totally prevents relative displacements of the respective ends 4, 14 of the first 2 and second 3 footwear elements. This means that, due to the invention, the second footwear element 3 is better retained in the first footwear element 2 compared to a boot according to the prior art. It can be said that no, or only very few, undesired displacements are observed between the rear ends 4, 14 of the respective footwear elements. This results in improved comfort, as well as a better transmission of impulses and sensory information. The resulting advantages include reduced user fatigue, improved sports performance, and increased safety.

By way of non-limiting example, and still according to the first embodiment of the invention, the retaining device 20 comprises a first part 21 associated with the first footwear element 2, and a second part 22 associated with the second footwear element 3, the first part 21 and second part 22 having complementary shapes. As further described below, the complementary shapes of the parts 21, 22 enable one of the parts to take support on the other, or vice versa, so that the mechanical clearances are minimal to non-existent. This advantageously optimizes the transmission of impulses and sensory information in the area of the first 2 and second 3 footwear elements.

By way of example, the first part 21 is an inner stop projecting forward within the first footwear element 2. The first part 21 can be characterized as an internal stop, that is, it is positioned internally of the first footwear element 2. The stop 21 here has the shape of an angle bracket, that is, an L-shape, that comprises an upwardly extending first arm 23, affixed to the rear end 4 of the first footwear element 2, and a second arm 24 extending forwardly from an upper end of the first arm 23, structured and arranged to cooperate with the second footwear element 3, as explained below. In a complementary manner, the second part 22 is an end piece projecting rearward, on the outside of the second footwear element 3. For example, the second footwear element 3 is structured to include an outer sole assembly 25 and an upper 26. In this case, the rear end piece 22 is a subdivision of the outer sole assembly 25, a subdivision which projects rearward beyond the upper 26. The end piece 22 has an active surface 27, which is an upwardly facing external surface of the second footwear element 2, provided to come into contact with the stop 21, the stop 21 being upwardly spaced from the inner boot-supporting surface of the first footwear element 2. The active surface 27 here is parallel to the outer sole assembly 25. As further described below, when the second footwear element 3 is completely inserted into the first footwear element 2, the second arm 24 of the stop 21 is capable of taking support on the active surface 27 of the end piece 22. This prevents the heel 14 of the second footwear element 3 from being lifted within the first footwear element 2. In other words, this prevents the end piece 22 from moving away from the base 8 of the first footwear element 2, that is, away from the inner boot-supporting surface of the first footwear element.

By way of example, the insertion of the second footwear element 3 into the first footwear element 2, or its removal therefrom, is provided to occur in the area of the rear end 4 of the first footwear element 2. This is the reason why the first footwear element 2 has a rear opening 30. As can be understood especially with reference to FIGS. 3-5, the insertion of the second footwear element 3 into the first footwear element 2 is carried out with forward movement through the opening 30, when cleared, along the longitudinal direction L. The removal of the second element 3 is also carried out via the opening, but with rearward movement. The insertion and removal are easy-to-perform natural movements. In correlation with the position of the opening 30, the structure of the front portion of the first footwear element 2 is continuous, for better imperviousness. This means that the lower portion 10 has a continuous structure, that is to say, without an opening, ahead of the upper portion 11. Advantageously, it follows that foreign matter can in no way penetrate into the first footwear element 2 during use, such as during walking.

The opening 30 of the first footwear element 2 is a wide cutout to facilitate the passage of the second footwear element 3. A wide cutout here contrasts with a slit cutout, such as slit cutouts 65 and 67, described below with regard to the second and third embodiments shown in FIGS. 8 and 9. That is, whether the cutout is open or closed by a tongue 31 of the first footwear element 2, it has a transverse width between medial and lateral edges. For example, the opening has a width equal to or greater than three centimeters. The width of the opening 30 may be equal to the width of the first footwear element 2, in the area of the rear end 4. The first footwear element 2 also includes a connecting mechanism 32, 33 for connecting the tongue 31 to the remainder of the first footwear element 2 at the aforementioned lateral and medial edges, i.e., the connecting mechanism can be said to be structured and arranged to selectively block and unblock the tongue to the remainder of the first footwear element 2 via the opening. It is thus possible to maintain the second footwear element 3 in the first footwear element 2 after insertion. As shown in the drawings, the rear surface of the tongue comprises a portion of the rear surface of the upper portion of the first footwear element 2.

According to the first embodiment of the invention, the connecting mechanism 32, 33 comprises two slide fasteners, namely, a lateral fastener 32 and a medial fastener 33, such as first and second zippers. Each fastener 32, 33 extends height-wise, from the base 8 to the upper end 9. This enables a complete rearward clearance of the tongue 31, for easier passage of the second footwear element 3 through the opening 30. FIG. 5 shows that when the second footwear element 3 is housed in the first footwear element 2, with the tongue 31 retained by the slide fasteners in the position for closing the opening 30, the stop 21 then being in contact with the end piece 22. In fact, the closing of the opening 30 causes the heel 14 of the second footwear element 3 to be immobilized in relation to the heel 4 of the first footwear element 2. This enables accurate transmission of the impulses and sensory information in the area of the heel of the user.

Also, in the context of the invention, the inner volume of the lower portion 10 of the first footwear element 2 is equal to, or barely greater than the outer volume of the lower portion 12 of the second footwear element 3. This enables accurate retention of the second footwear element 3 in the first footwear element 2. Good results have been obtained when the aforementioned inner volume ranges between 100% and 110% of the outer volume. The precise adjustment of the volume requires precision to fit the second footwear element 3 into the first footwear element 2. To facilitate the insertion, the boot 1 includes a guide 34 for positioning the second footwear element 3 in the first footwear element.

By way of example, the guide 34 is a rigid plate located in the area of the rear end 4 of the first footwear element 2. The guide is affixed to the tongue 31, above the stop 21. This means that the guide 34 is farther from the base 8 than is the stop. A function of the guide 34 is the pushing of the end piece 22 forward of the stop 21, when the heel 14 of the second footwear element 3 is lowered toward the base 8 of the first footwear element 2. As can be understood in particular with reference to FIGS. 4 and 5, the heel 14 is lowered while the slide fasteners 32, 33 are in the open position, with the tongue 31 being cleared rearward. When the end piece 22 is sufficiently lowered toward the base 8, as in FIG. 5, it can cooperate with the stop 21, as noted.

In a non-limiting manner, the guide 34 and the first part 21 of the retaining device 20 are connected to one another. In practice, it is the guide 34 and the stop 21 that are connected to one another. This facilitates their cooperation.

The preceding description demonstrates that the boot 1 can be used in its entirety, meaning that the user can walk when the second footwear element 3 is inserted into the first footwear element 2. Alternatively, the boot 1 can be used partially; in this case the user walks only with the second footwear element 3. However, there is another possibility, which involves using the boot in its entirety, with a sports apparatus, such as a crampon 41.

Figure 6:
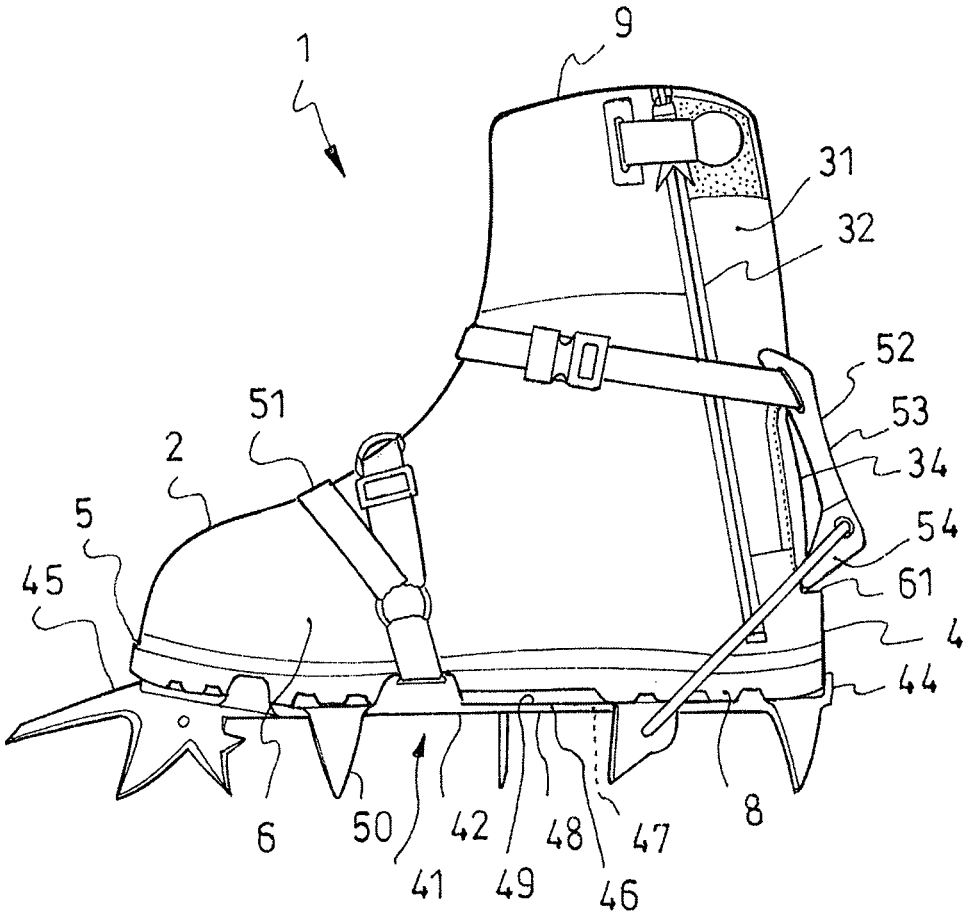
FIG. 6 is a side view showing an assembly comprising a crampon and the boot according to the first embodiment.
Figure 7:
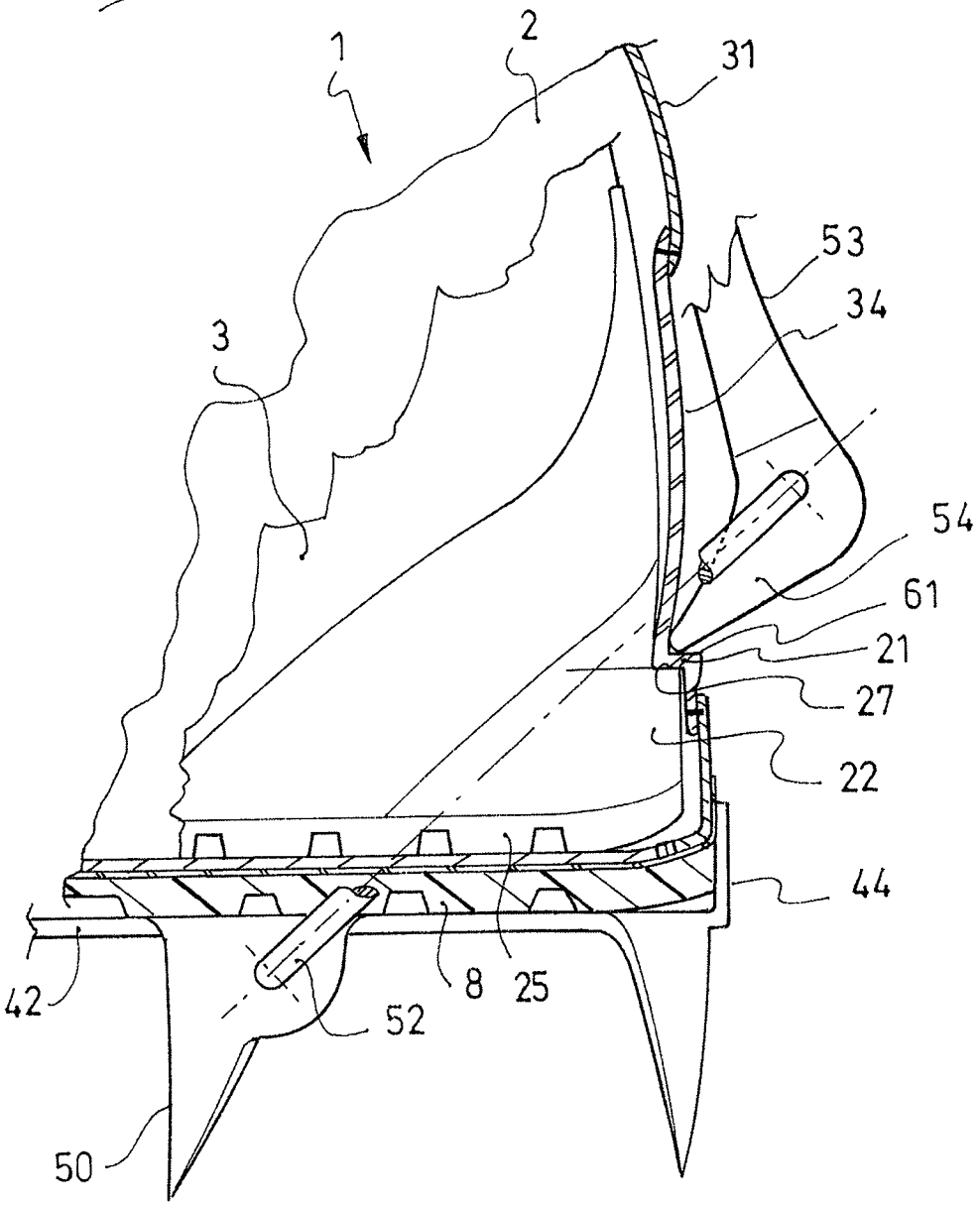
FIG. 7 is a partial exploded view of FIG. 6.

An assembly is illustrated with reference to FIGS. 6 and 7. The crampon 41 includes, as defined in the NF EN 893: 2011-01 standard, a body 42 extending lengthwise from a rear end 44 to a front end 45, widthwise from a first transverse edge 46 to a second transverse edge 47, and height-wise between a support surface 48 and a receiving surface 49. The support surface carries points 50, adapted to be anchored in the ground, and the receiving surface 49 receives the boot 1. Still according to the standard, the crampon 41 comprises a binding, with a front retaining device 51 and a rear retaining device 52. By way of example, the rear retaining device 52 includes a locking mechanism 53 with, in particular, a jaw 54 adapted to cooperate with the boot 1, as described below.

In this cooperative arrangement, the first footwear element 2 includes an outer stop 61 for receiving the jaw 54. The outer stop 61 can be characterized as an external stop, that is, it is positioned externally of the first footwear element. In a non-limiting fashion, still according to the first embodiment of the invention, the outer stop 61 is formed by the second arm 24 of the inner stop 21. This means that the second arm 24 has two opposed surfaces, one of which forms the inner stop 21 and the other forms the outer stop 61, that is, with the downwardly facing internal surface being directly beneath the upwardly facing external surface. This enables a direct transmission of the steering impulses and sensory information between the rear retaining device 52 and the second footwear element 3. Taking support on the ground is therefore precise and reliable.

To simplify the manufacture of the boot 1, the inner stop 21, outer stop 61, and guide 34 form a unitary element (i.e., a one-piece element), made for example of synthetic material, such as a reinforced or non-reinforced plastic material.

Still in the context of simplification, but also efficiency, the unitary element can be a subdivision of a rear portion 31 of the first footwear element 2, this portion being the tongue in this case.

Additional embodiments of the invention are briefly described below with reference to FIGS. 8 and 9. For reasons of convenience, the elements shared with the first embodiment are designated by the same reference numerals.

Figure 8:
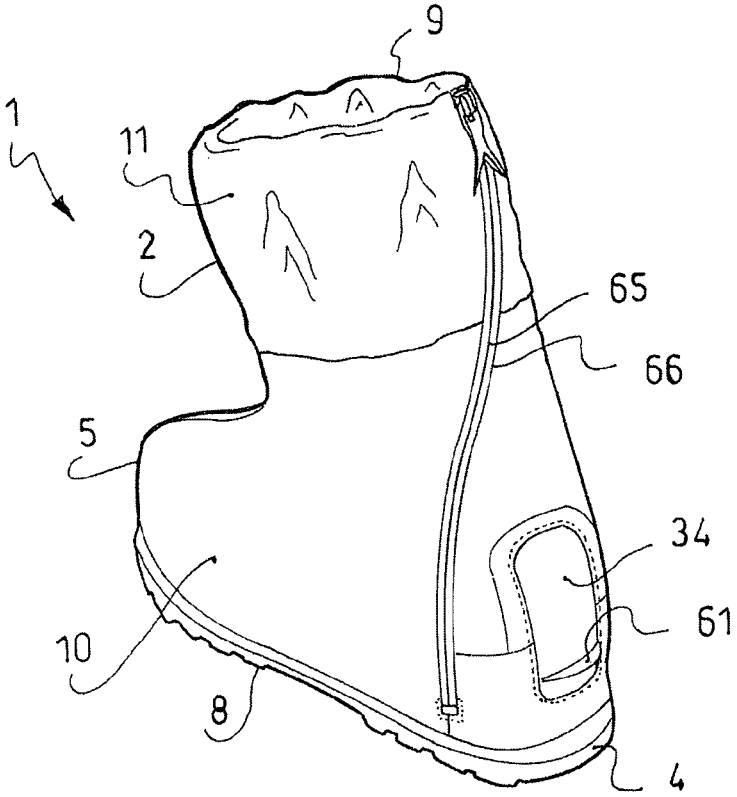
FIG. 8 is a rear perspective view of a boot according to a second embodiment of the invention.

The second embodiment, according to FIG. 8, includes a boot 1 with, in particular, the first footwear element 2 and the unitary element. This boot is specific in that the rear opening is a slit 65. This slit can be closed by any suitable means but, according to the second embodiment, a slide fastener 66, such as a zipper, closes the slit 65. This simplifies the manufacture. The slit 65 and the slide fastener 66 are in an oblique position in the area of the rear of the boot, i.e., it extends other than vertical, for example.

Figure 9:
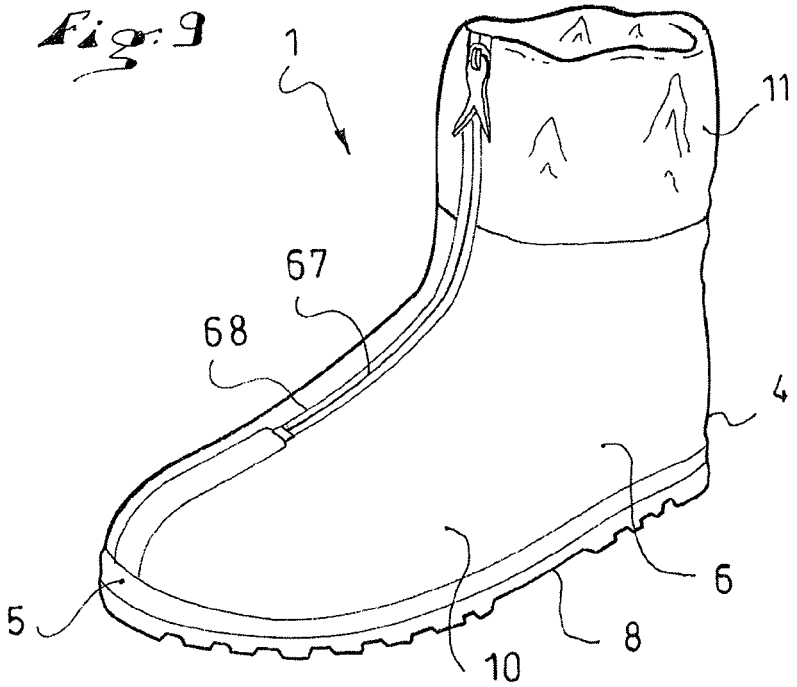
FIG. 9 is a front perspective view of a boot according to a third embodiment of the invention.

The third embodiment, according to FIG. 9, includes a boot 1 with, in particular, the first footwear element 2. This boot is specific in that the first footwear element 2 has a front opening 67 closed by any suitable means, such as a slide fastener 68, such as a zipper, the front opening 67 being a slit, for example.

In any case, the invention is made from materials and using techniques of implementation known to one of ordinary skill in the art.

The invention is not limited to the particular embodiments described above, and includes all technical equivalents that fall within the scope of the claims that follow.

In particular, other structures may be provided to make the stops 21, 61, and the guide 34.

Any upper or sole assembly structure may be provided for each of the footwear elements 2, 3, with devices for tightening the upper, if necessary.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A boot comprising:

a first footwear element and a second footwear element;

the second footwear element being sized, structured, and arranged to be removably inserted into the first footwear element;

the first footwear element extending lengthwise from a rear end to a front end, widthwise between a lateral side and a medial side, and height-wise from a base to an upper end;

the second footwear element extending lengthwise from a rear end to a front end, widthwise between a lateral side and a medial side, and height-wise from a base to an upper end;

a second-footwear-element retainer configured to retain the rear end of the second footwear element against upward movement of the second footwear element at the rear end of the first footwear element, said second-footwear-element retainer comprising:

a first part of the first footwear element, and a second part of the second footwear element;

the first part and second part having complementary shapes;

the first part comprising an internal stop positioned internally of the first footwear element and spaced from an internal boot-supporting surface of the first footwear element, the first part being configured to engage with the second part when the second footwear element is positioned within the first footwear element;

the first footwear element comprising a crampon-retaining external stop positioned externally of and extending rearwardly at the rear end of the first footwear element, and configured to be engaged by a crampon retaining device;

the internal stop of the first part including an arm extending in a direction forwardly from the rear end of the first footwear element, the arm being configured to engage with the second part; and the external stop of the first footwear element comprising the arm of the internal stop of the first part.

2. The boot according to claim 1, wherein:

the second part of the retainer is an end piece, projecting rearwardly from the end of the second footwear element.

3. The boot according to claim 1, further comprising:

a guide structured and arranged to position the second footwear element into the first footwear element.

4. The boot according to claim 3, wherein:

the guide and the first part of the retaining device are connected to one another.

5. The boot according to claim 3, wherein:

the inner stop, the outer stop, and the guide form a unitary one-piece element.

6. The boot according to claim 5, wherein:

the one-piece unitary element is a subdivision of a rear portion of the first footwear element.

7. The boot according to claim 1, wherein:

the first footwear element has a rear opening for receiving the second footwear element into the first footwear element.

8. A boot according to claim 7, wherein:

the opening is a wide cutout;

the first footwear element comprises a tongue configured to block the opening, as well as a connecting mechanism structured and arranged for selectively blocking and unblocking the tongue to the remainder of the first footwear element via the opening.

9. The boot according to claim 8, wherein:

the connecting mechanism comprises two spaced-apart slide fasteners comprising a lateral slide fastener and a medial slide fastener.

10. The boot according to claim 7, wherein:

the rear opening is a slit.

11. The boot according to claim 10, wherein:

a slide fastener closes the slit.

12. The boot according to claim 8, wherein:

the tongue has a rear surface comprising a rear surface portion of the upper portion of the first footwear element;

the cutout has a transverse width between medial and lateral edges that demarcate the cutout; and the rear surface of the tongue has a width occupying the width of the cutout.

13. The boot according to claim 1, wherein:

the first footwear element has a front opening.

14. The boot according to claim 1, wherein:

the upper end of the second footwear element has a circumferential edge, said circumferential edge being lower than the upper end of the first footwear element.

15. The boot according to claim 1, wherein:

the second footwear element comprises an outer sole assembly and an upper; and the second part of the retainer is a subdivision of the outer sole assembly of the second footwear element that projects rearward beyond the upper.

16. The boot according to claim 1, wherein:

the rear end of the second footwear element is a heel of the second footwear element; and the second part of the retainer is an external rear end piece, projecting rearwardly from the heel of the second footwear element.

17. The boot according to claim 1, wherein:

the first part of the first footwear element has an L-shape;

the L-shape is comprised of:

an upwardly extending arm; and the arm of the internal stop of the first part extending forwardly from an upper end of the upwardly extending arm.

18. The boot according to claim 17, further comprising:

a guide structured and arranged to position the second footwear element into the first footwear element, the guide extending upwardly from the arm of the internal stop of the first part.

19. The boot according to claim 1, wherein:

the first footwear element comprises a foot-supporting base and a foot-covering upper portion from a lateral side to a medial side.

20. The boot according to claim 1, wherein:

the first footwear element comprises a foot-supporting base and a foot-covering and ankle-covering upper portion.

21. Art assembly comprising:

a crampon; and a boot comprising:

a first footwear element and a second footwear element;

the second footwear element being sized, structured, and arranged to be removably inserted into the first footwear element;

the first footwear element extending lengthwise from a rear end to a front end, widthwise between a lateral side and a medial side, and height-wise from a base to an upper end;

the second footwear element extending lengthwise from a rear end to a front end, widthwise between a lateral side and a medial side, and height-wise from a base to an upper end;

a second-footwear-element retainer configured to retain the rear end of the second footwear element against upward movement of the second footwear element at the rear end of the first footwear element, said second-footwear-element retainer comprising:

a first part of the first footwear element, and a second part of the second footwear element;

the first part and second part having complementary shapes;

the first part comprising an internal stop positioned internally of the first footwear element and spaced from an internal boot-supporting surface of the first footwear element, the first part being configured to engage with the second part when the second footwear element is positioned within the first footwear element;

the first footwear element comprising a crampon-retaining external stop positioned externally of and extending rearwardly at the rear end of the first footwear element, and configured to be engaged by a crampon retaining device;

the internal stop of the first part including an arm extending in a direction forwardly from the rear end of the first footwear element, the arm being configured to engage with the second part; and the external stop comprising the arm of the internal stop of the first part.

22. The assembly according to claim 21, wherein:

the crampon comprises a binding, said binding comprises the retaining device, the retaining device having a locking mechanism configured to lock the crampon to the boot, the locking mechanism comprising a jaw; and the jaw of the locking mechanism is configured to cooperate with the external stop of the first boot.

23. The assembly according to claim 21, wherein:

the first part of the first footwear element has an L-shape;

the L-shape is comprised of:

an upwardly extending arm; and the arm of the internal stop of the first part extending forwardly from an upper end of the upwardly extending arm.

24. The assembly according to claim 23, further comprising:

a guide structured and arranged to position the second footwear element into the first footwear element, the guide extending upwardly from the arm of the internal stop of the first part.

25. The assembly according to claim 21, wherein:

the first footwear element comprises a foot-supporting base and a foot-covering upper portion from a lateral side to a medial side.

26. The assembly according to claim 21, wherein:

the first footwear element comprises a foot-supporting base and a foot-covering and ankle-covering upper portion.

* * * * *